US012371286B2

(12) United States Patent
Ishii

(10) Patent No.: US 12,371,286 B2
(45) Date of Patent: Jul. 29, 2025

(54) SHEET FEEDING CASSETTE AND IMAGE FORMING APPARATUS

(71) Applicant: KYOCERA Document Solutions Inc., Osaka (JP)

(72) Inventor: Akira Ishii, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 210 days.

(21) Appl. No.: 18/550,335

(22) PCT Filed: Jan. 28, 2022

(86) PCT No.: PCT/JP2022/003371
§ 371 (c)(1),
(2) Date: Sep. 13, 2023

(87) PCT Pub. No.: WO2022/196129
PCT Pub. Date: Sep. 22, 2022

(65) Prior Publication Data

US 2024/0150143 A1 May 9, 2024

(30) Foreign Application Priority Data

Mar. 19, 2021 (JP) ..... 2021-045862

(51) Int. Cl.
*B65H 1/14* (2006.01)

(52) U.S. Cl.
CPC ..... *B65H 1/14* (2013.01); *B65H 2405/114* (2013.01); *B65H 2511/12* (2013.01)

(58) Field of Classification Search
CPC ... B65H 1/04; B65H 1/08; B65H 1/14; B65H 2405/114; B65H 2405/1144; B65H 2511/12
See application file for complete search history.

(56) References Cited

U.S. PATENT DOCUMENTS 10,364,108 B2 7/2019 Daigo
2013/0134657 A1* 5/2013 Nishioka ..... B65H 1/14 271/147

(Continued)

FOREIGN PATENT DOCUMENTS

CN 207986412 U 10/2018
JP 2003-201024 A 7/2003
JP 2019-011155 A 1/2019

OTHER PUBLICATIONS

An Office Action mailed by China National Intellectual Property Administration on Apr. 23, 2025, which corresponds to Chinese Patent Application No. 202280021308.7 and is related to U.S. Appl. No. 18/550,335; with English language translation.

*Primary Examiner* — Prasad V Gokhale
(74) *Attorney, Agent, or Firm* — Studebaker Brackett PLLC

(57) ABSTRACT

A sheet feeding cassette (21) includes a body part (31), a placement plate (33) disposed on a bottom plate (31*a*) of the body part (31), a shaft (61) extending along a width direction, a lift plate (35) configured to be turned around the shaft (61) to lift and lower a downstream end portion of the placement plate (33), and a pair of side cursors (37F, 37R). Both end portions of the shaft (61) are rotatably supported by the body part (41), outside in the width direction of the side cursors (37F, 37R) disposed at the most separate position. The side cursors (37F, 37R) each has an abutment wall (71F, 71R) abutting on a side surface of the sheet and a recess (79) externally fitted to the shaft (61) from above, and the recess (79) slides on the shaft (61) when the side cursors (37F, 37R) move in the width direction.

8 Claims, 7 Drawing Sheets

(56) References Cited

U.S. PATENT DOCUMENTS

| | | | | |
|---|---|---|---|---|
| 2016/0289020 | A1* | 10/2016 | Hayakawa | B65H 1/18 |
| 2018/0143576 | A1* | 5/2018 | Nishioka | G03G 15/6508 |
| 2018/0222698 | A1* | 8/2018 | Yoshida | B65H 1/08 |
| 2019/0002220 | A1* | 1/2019 | Daigo | B65H 1/14 |

* cited by examiner

SHEET FEEDING CASSETTE AND IMAGE FORMING APPARATUS

TECHNICAL FIELD

The present invention relates to a sheet feeding cassette in which a sheet is stored and an image forming apparatus including the sheet feeding cassette.

BACKGROUND

The sheet feeding cassette includes a body part in which a sheet is stored and a placement plate which is disposed on the bottom plate of the body part and on which the sheet is placed. In order to lift the sheet placed on the placement plate to a sheet feeding position, the placement plate may be configured to be turnable in the upper-and-lower direction. In this case, the placement plate is turned by a lift plate. The lift plate is disposed between the bottom plate of the body part and the placement plate, and pivots around a shaft to push up the placement plate. This causes the placement plate to turn, and the downstream end of the sheet in the feeding direction is lifted to the sheet feeding position.

For example, the sheet feeding cassette described in Patent Document 1 includes an actuating plate (corresponding to the lift plate) fixed to one end of a turning shaft (corresponding to the shaft) to push up a turning end (corresponding to the downstream end) of a sheet placement plate (corresponding to the placement plate).

PRIOR ART DOCUMENTS

Patent Literature

Patent Document 1: Japanese Patent Laid-Open No. 2019-11155

SUMMARY OF THE INVENTION

Problems to be Solved by Invention

The actuating plate described in the above Patent Document 1 is fixed to one end of the turning shaft. The other end of the turning shaft penetrates through the side wall of the storage part (corresponding to the body part) and is connected to a drive source by a coupling. In such a configuration, when the turning shaft is rotated to turn the actuating plate and to push up the sheet placement plate, the weight of the sheet placed on the sheet placement plate is added to the turning shaft through the actuating plate and further to the side wall through which the turning shaft penetrates. If the weight is added to one side wall in this way, there is a risk that the storage part will be deformed. When the storage part is deformed, there is a problem that the sheet feeding cassette interferes with the apparatus main body when the sheet feeding cassette is attached to and detached from the apparatus main body.

To solve the above problems, it is an object of the present invention to provide a sheet feeding cassette which is not easily deformed by a load applied from a lift plate and an image forming apparatus.

Means of Solving the Problems

A sheet feeding cassette according to the present invention includes a body part in which a sheet to be fed along a predetermined feeding direction is stored; a placement plate disposed on a bottom plate of the body part and having a sheet placement surface on which the sheet is placed; a shaft extending along a width direction intersecting the feeding direction; a lift plate disposed between the bottom plate and the placement plate and configured to be turned around the shaft to lift and lower a downstream end portion of the placement plate in the feeding direction; a pair of side cursors movably supported on the bottom plate in directions approaching and separating from each other along the width direction to position the sheet placed on the sheet placement surface in the width direction; and guide grooves formed in the bottom plate along the width direction to guide movement of the side cursors, wherein both end portions of the shaft are rotatably supported by bearing parts provided in the body part, outside in the width direction of the side cursors disposed at the most separate position in the width direction, the side cursors each has: an abutment wall abutting on a side surface of the sheet; and a recess formed at a lower end portion of the abutment wall and externally fitted to the shaft from above, and the recess slides on the shaft when the side cursors move in the width direction.

In the sheet feeding cassette according to the present invention, the bottom plate may have a plurality of receiving parts formed in an upper edge of a rib along the feeding direction and supporting the shaft from below, and the receiving parts may be arranged at a center portion and both end portions in the width direction.

An image forming apparatus includes the sheet feeding cassette; and an image forming part which forms an image on the sheet fed from the sheet feeding cassette.

Effects of the Invention

According to the present invention, since the load applied from the placement plate to the lift plate is distributed in the width direction, a biased deformation of the body part can be prevented.

EMBODIMENT FOR CARRYING OUT THE INVENTION

Hereinafter, with reference to the drawings, an image forming apparatus and a sheet feeding cassette according to one embodiment of the present invention will be described.

Figure 1:
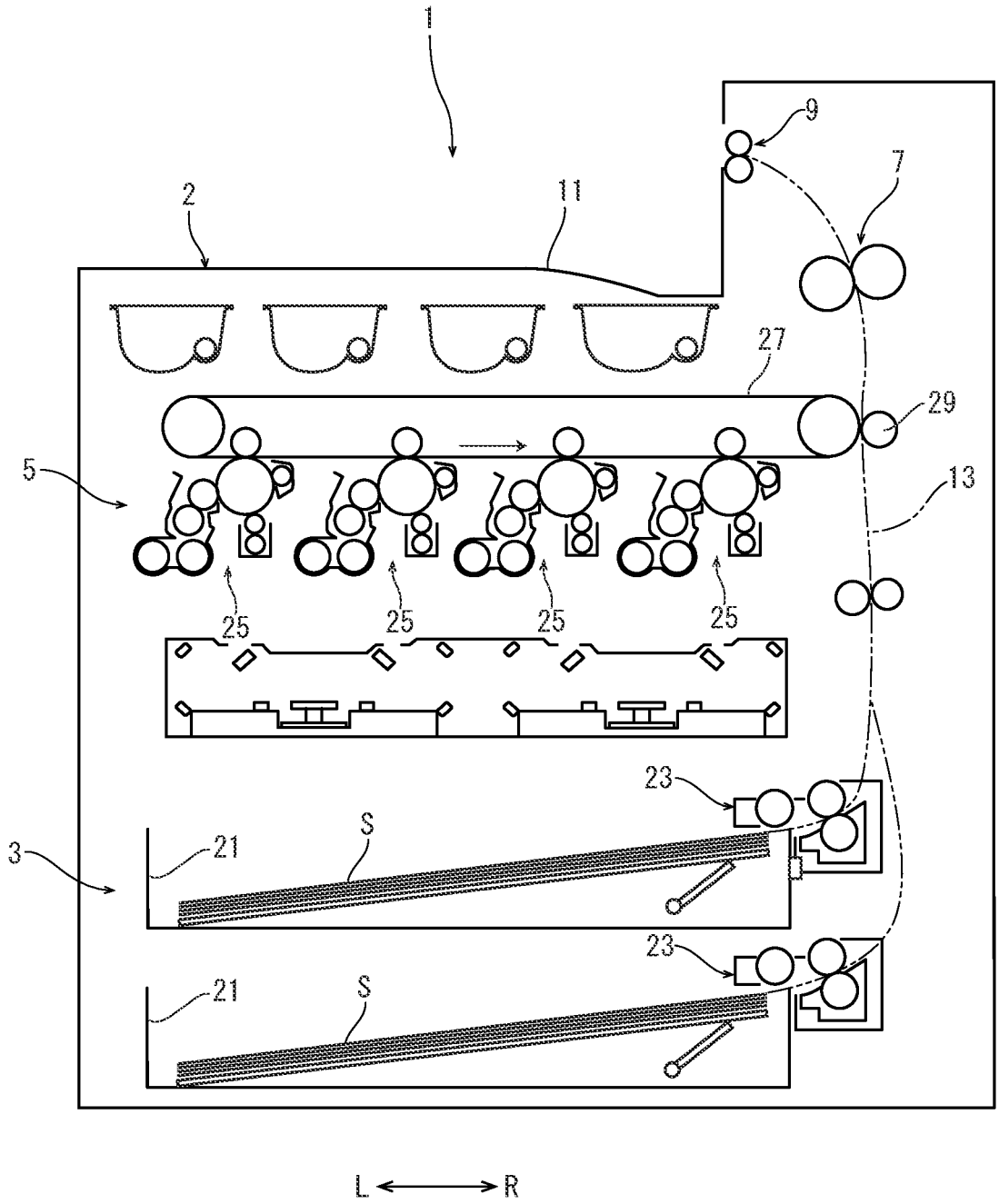
FIG. 1 is a front view schematically showing an inner structure of an image forming apparatus according to one embodiment of the present invention.

First, the entire configuration of the image forming apparatus 1 according to this embodiment will be described with reference to FIG. 1. FIG. 1 is a sectional view schematically showing the internal structure of the image forming apparatus 1. In each figure, Fr, Rr, L and R indicate the front, rear, left and right sides of the image forming apparatus, respectively.

The apparatus main body 2 of the image forming apparatus 1 includes a sheet feeding part 3, an electrophotographic image forming part 5, a fixing device 7, and a discharging device 9. A discharge tray 11 is formed on the upper surface of the apparatus main body 2. In the apparatus main body 2, a sheet conveyance path 13 is formed from the sheet feeding part 3 to the discharging device 9 via the image forming part 5 and the fixing device 7.

The sheet feeding part 3 includes a sheet feeding cassette 21 in which a sheet is stored and a sheet feeding device 23 which feeds the sheet from the sheet feeding cassette 21 in the feeding direction toward the conveyance path 13. The sheet feeding cassette 21 is attached to and detached from the apparatus main body 2 in the front-and-rear direction through an opening (not shown) formed in the front surface of the apparatus main body 2. In the following description of the sheet feeding part 3, the upstream side and the downstream side refer to the upstream side and the downstream side in the feeding direction. In this embodiment, the feeding direction is a direction from the left side to the right side. The direction intersecting the feeding direction is defined as the width direction. The sheet feeding cassette 21 will be described later.

The image forming part 5 includes four process cartridges 25 corresponding to four colors (yellow, magenta, cyan and black) of toner, an intermediate transfer belt 27 circulating and traveling, and a transfer roller 29. The four process cartridges 25 are arranged side by side along the traveling direction of the intermediate transfer belt 27, facing the under track of the belt 27. The four process cartridges 25 forms a full color toner image on the travelling intermediate transfer belt 27 by superimposing the toner image of each color. The formed toner image is transferred to the sheet conveyed along the conveyance path 13 at a transfer nip formed between the transfer roller 29 and the intermediate transfer belt 27.

The fixing device 7 fixes the toner image transferred to the sheet to the sheet. The discharging device 9 discharges the sheet on which the toner image is fixed. The discharged sheet is stacked on the discharge tray 11.

Figure 2:
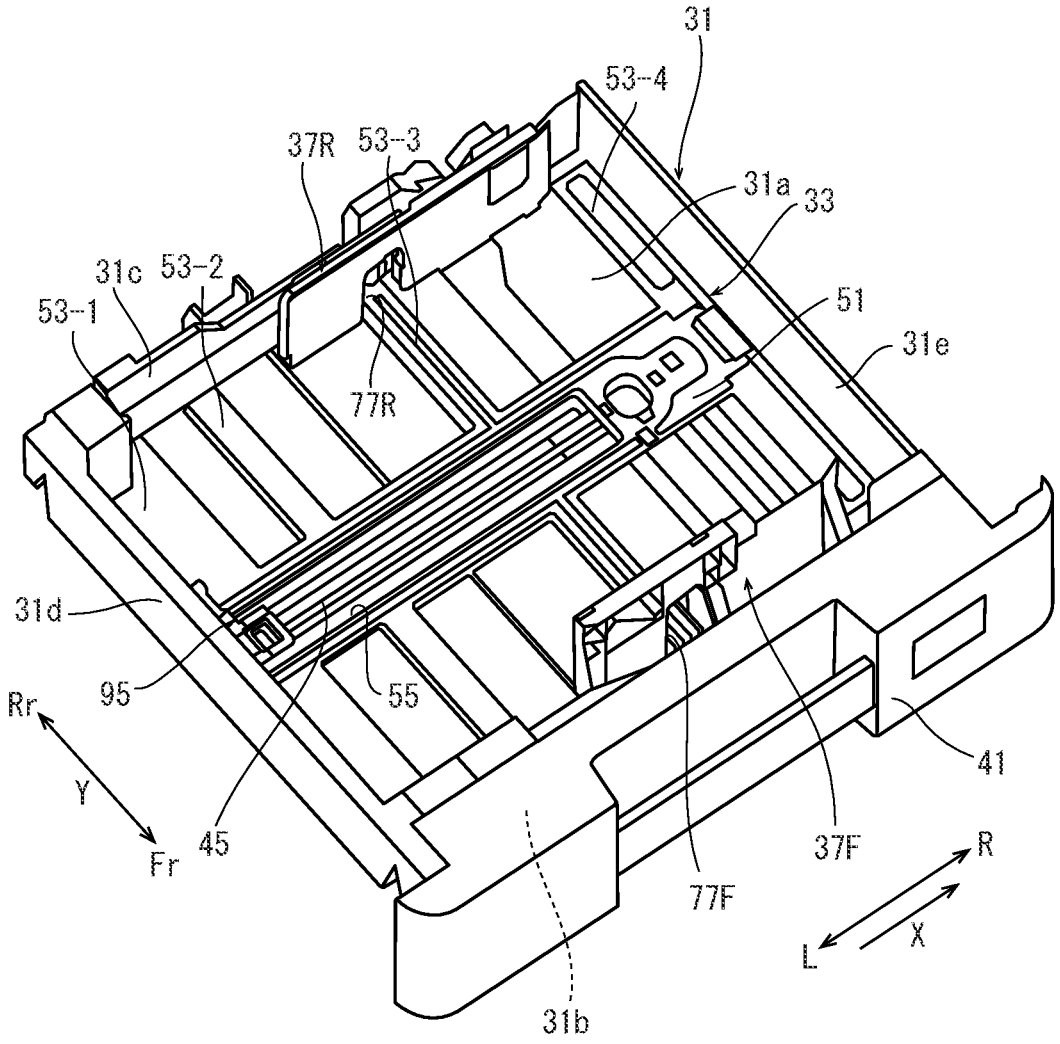
FIG. 2 is a perspective view showing a sheet feeding cassette according to the embodiment of the present invention.
Figure 3:
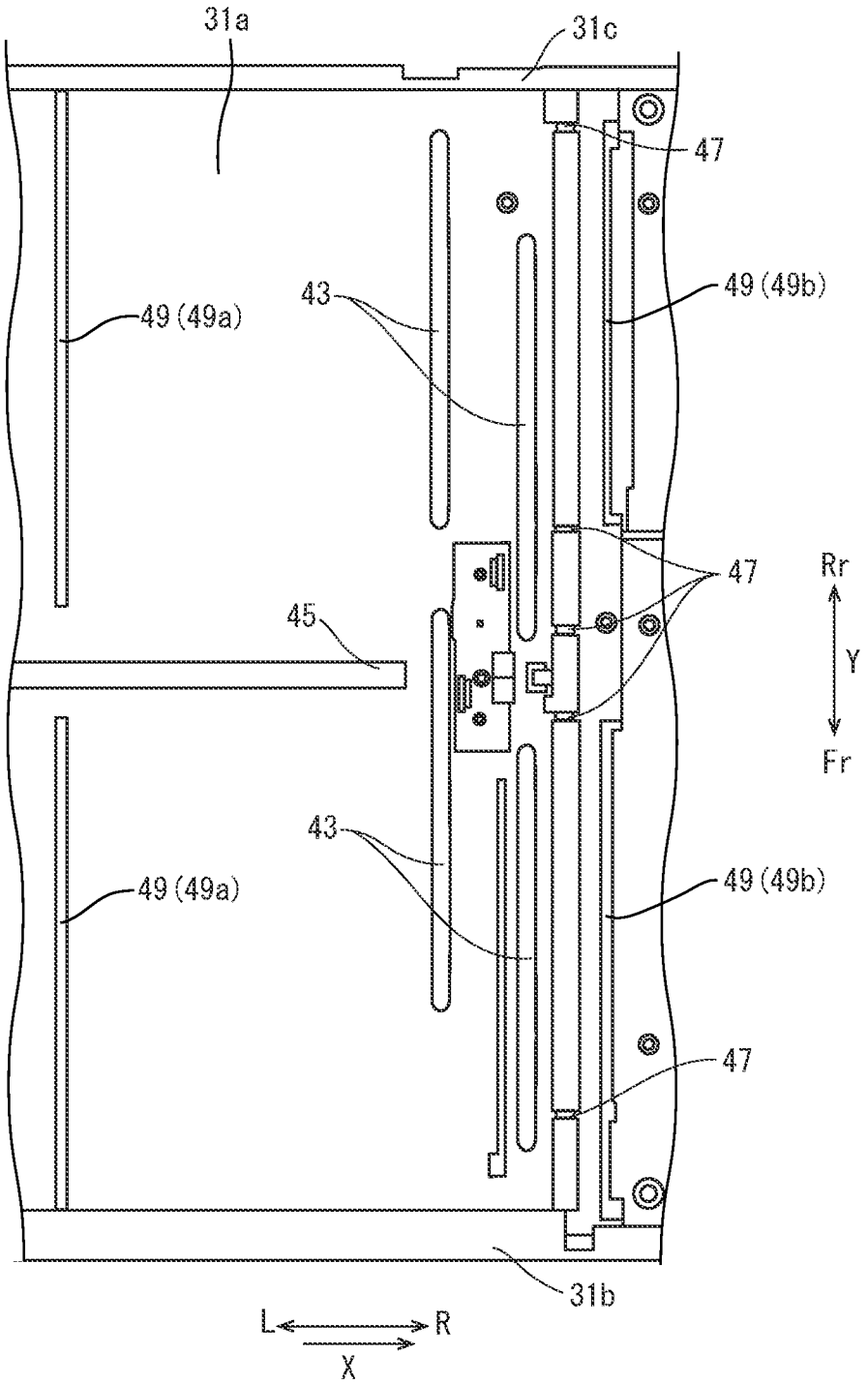
FIG. 3 is a plan view showing a downstream end portion of a bottom plate of the sheet feeding cassette according to the embodiment of the present invention.
Figure 4A:
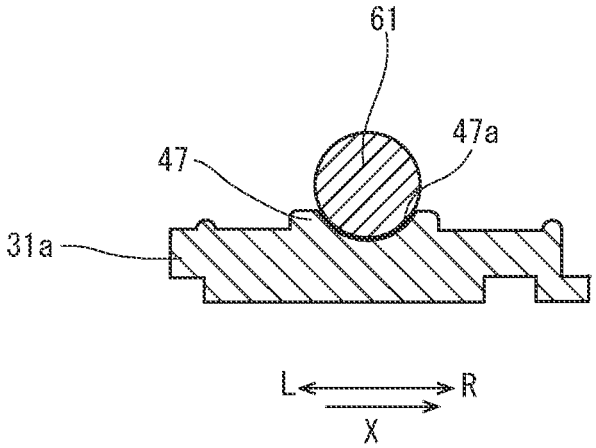
FIG. 4A is a sectional view showing a receiving part of the sheet feeding cassette according to the embodiment of the present invention, when viewed in the width direction.
Figure 4B:
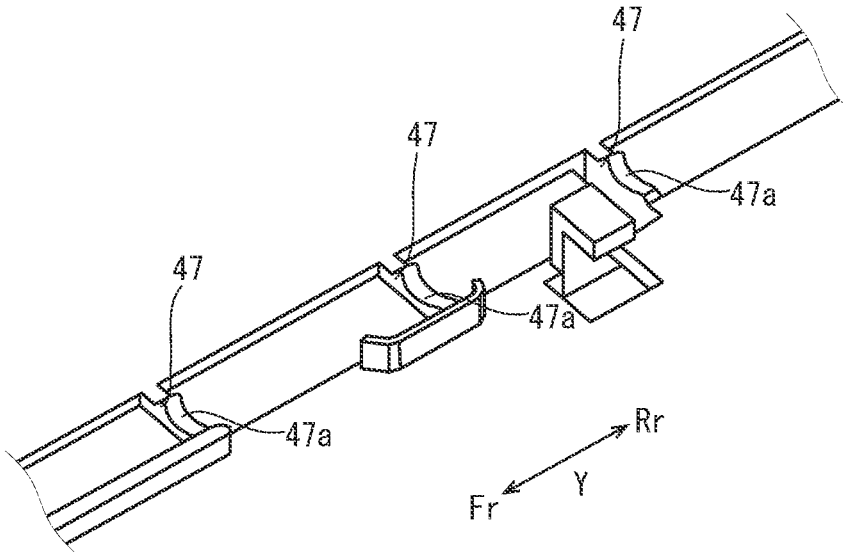
FIG. 4B is a perspective view showing the receiving part disposed in a center portion in the width direction, in the sheet feeding cassette according to the embodiment of the present invention.
Figure 5:
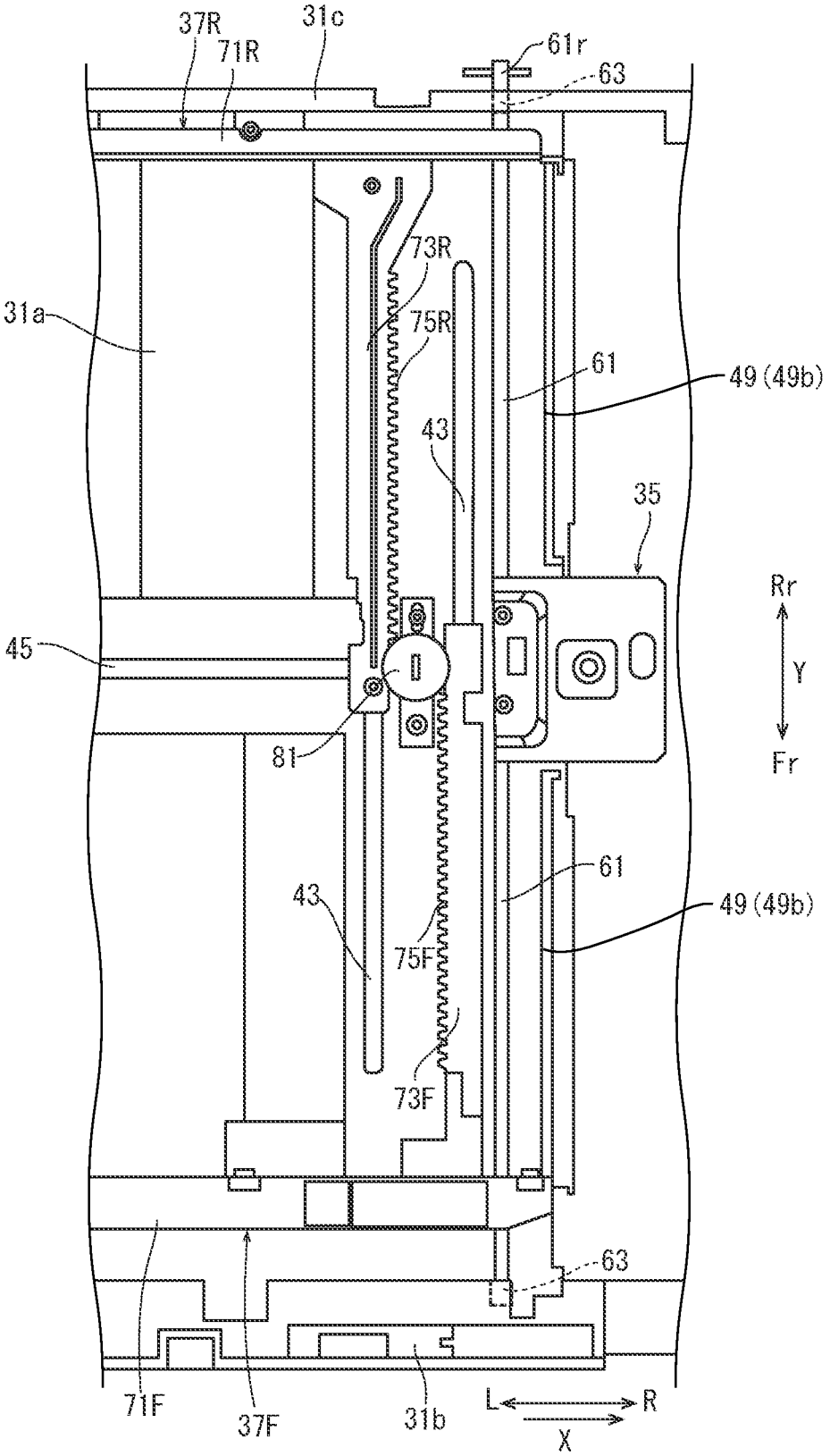
FIG. 5 is a plan view showing a downstream end portion of the sheet feeding cassette according to the embodiment of the present invention.
Figure 6:
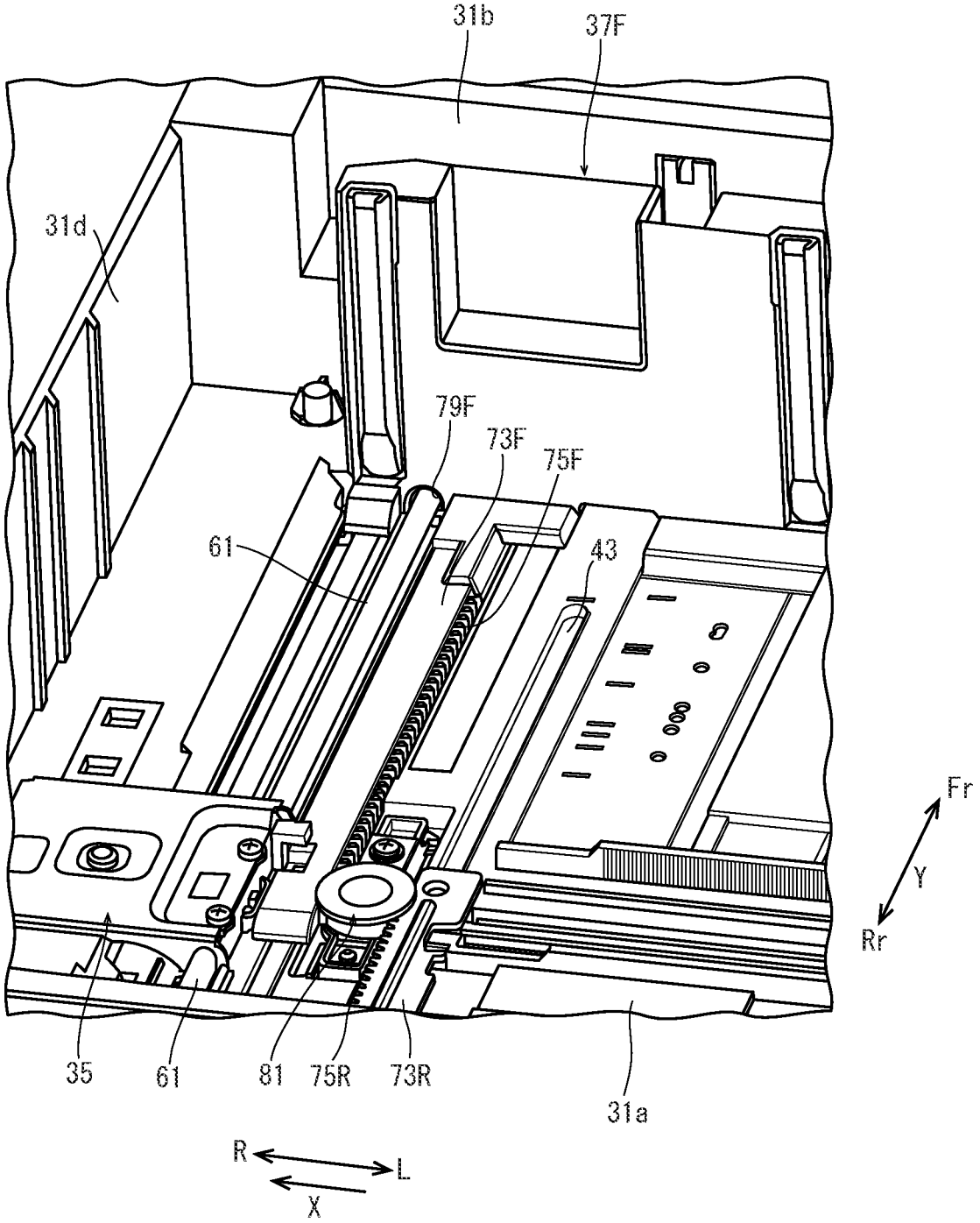
FIG. 6 is a perspective view showing a side cursor and a shaft, in the sheet feeding cassette according to the embodiment of the present invention.
Figure 7:
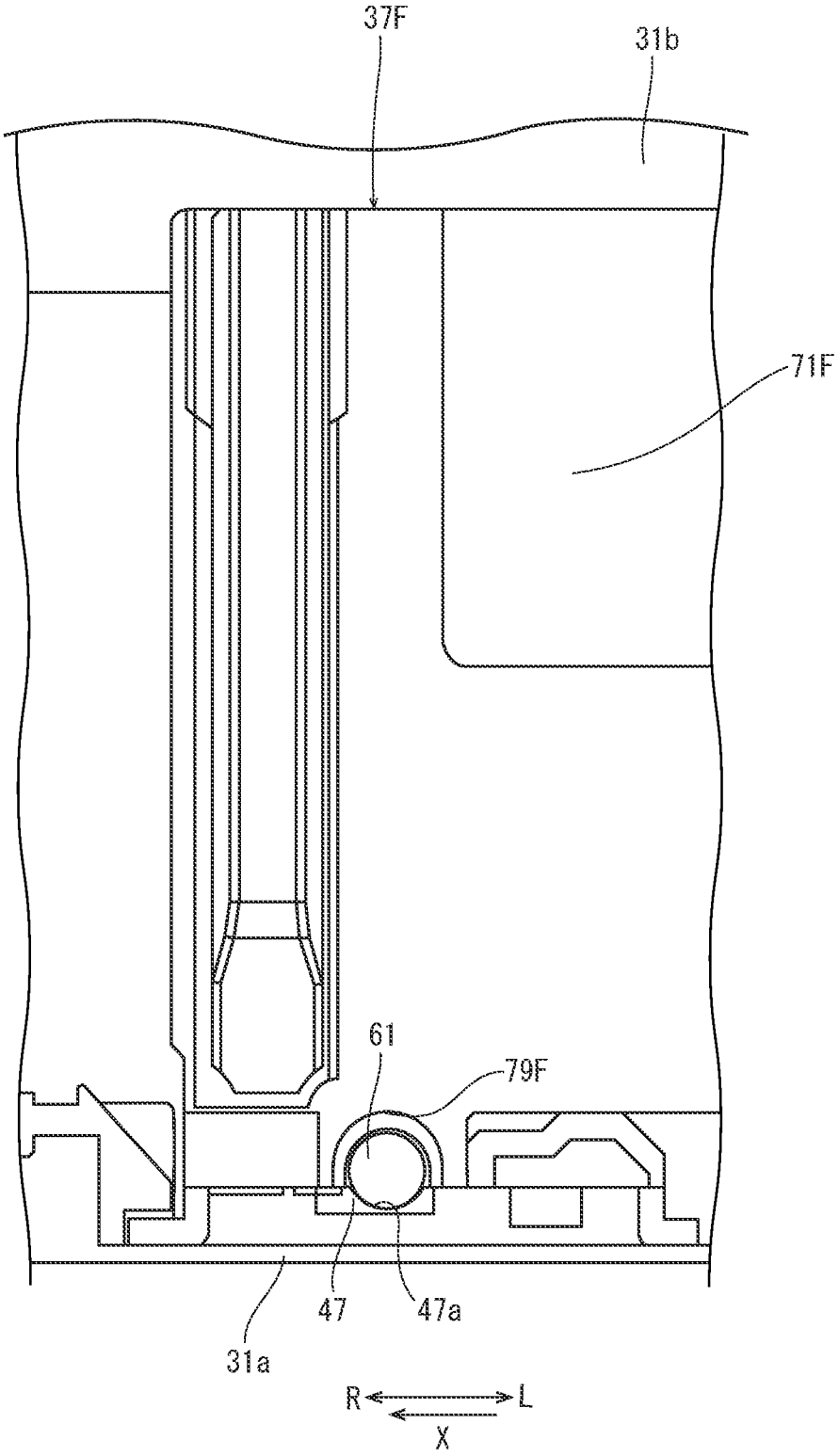
FIG. 7 is a view showing the side cursor and the shaft, when viewed in the width direction, in the sheet feeding cassette according to the embodiment of the present invention.

Next, the sheet feeding cassette 21 will be described with reference to FIG. 2 to FIG. 7. FIG. 2 is a perspective view showing the sheet feeding cassette 21, FIG. 3 is a plan view showing the downstream end portion of the bottom plate of the sheet feeding cassette 21, FIG. 4A is a sectional view showing the receiving part, FIG. 4B is a perspective view showing the receiving part arranged in the center portion in the width direction, FIG. 5 is a plan view showing the lift plate, FIG. 6 is a perspective view showing the shaft and the side cursor, and FIG. 7 is a view showing the shaft and the side cursor viewed from the width direction.

As shown in FIG. 2, the sheet feeding cassette 21 includes a body part 31 in which the sheet is housed, a placement plate 33 disposed on the bottom plate of the body part 31, a lift plate 35 (see FIG. 4) disposed below the placement plate 33, and a pair of side cursors 37 (37F, 37R) supported by the body part 31.

The body part 31 has a shallow box shape with the upper surface opened, and has a bottom plate 31*a*, front and rear side plates 31*b* and 31*c* facing in the front-and-rear direction, and left and right side plates 31*d* and 31*e* facing in the left-and-right direction. An outer cover 41 is provided on the front side plate 31*b* to close the opening of the apparatus main body 2 when the sheet feeding cassette 21 is attached to the apparatus main body 2.

The bottom plate 31*a* has a dimension that can accommodate a maximum size (for example, A3 size) of sheet. As shown in FIG. 3, on the downstream end portion (the right end portion) of the bottom plate 31*a*, a pair of first rails 43 along the width direction Y is formed with a predetermined interval in the feeding direction X. Furthermore, a second rail 45 along the feeding direction X is formed on the center portion of the bottom plate 31*a* in the width direction Y. The second rail 45 is formed between the upstream end portion of the bottom plate 31*a* and the first rails 43.

In addition, on the bottom plate 31*a*, a rib 47 is protruded along the width direction Y on the downstream side of the first rails 43. As shown in FIG. 4A, the rib 47 has a rectangular cross-sectional shape that is shorter in the height direction and longer in the feeding direction X. A plurality of (five, in this example) receiving parts 47*a* is formed on the upper end surface (the upper end edge) of the rib 47. Each receiving part 57*a* is formed in a U-shaped concave arc shape when viewed from the width direction Y. In this embodiment, as shown in FIG. 3, three receiving parts 47*a* (see also FIG. 4B) are arranged with predetermined intervals at the center portion in the width direction Y, and one receiving part 47*a* is arranged at each end portion in the width direction Y.

Furthermore, as shown in FIG. 3, on the bottom plate 31*a*, first guide grooves 49*a* and second guide grooves 49*b* are formed along the width direction Y on the upstream side of the first rails 43 and on the downstream side of the receiving parts 47*a*, respectively.

As shown in FIG. 2, the placement plate 33 has a dimension enabling of placing the maximum size sheet, and has a central part 51 along the feeding direction X and a plurality of (four, in this embodiment) of overhang parts 53 overhanging forward and rearward from the central part 51 along the width direction Y. The overhang parts 53 include, in order from the upstream side, first to fourth overhang parts 53-1, 53-2, 53-3 and 53-4. The upper surface of the placement plate 33 (the upper surfaces of the central part 51 and the first to fourth overhangs 53-1, 53-2, 53-3 and 53-4) is the placement surface on which the sheet is placed. A notch 55 along the feeding direction X is formed in the central part 51. Through this notch 55, the second rail 45 of the bottom plate 31*a* of the body part 31 is exposed.

The upstream end portion of the first overhang part 53-1 is turnably supported by supporting shafts (not shown) provided on the front and rear side plates 31*b* and 31*c* of the body part 31. The placement plate 33 can be turned from a horizontal posture along the bottom plate 31*a* of the body part 31 to an inclined posture in which the downstream end portion of the placement plate 33 is lifted around the supporting shafts.

The lift plate 35 has a rectangular shape having approximately the same width as the central part 51 of the placement plate 33, as shown in FIG. 5. The lift plate 35 is fixed to a center portion of a shaft 61, and is turned integrally with the shaft 61. The shaft 61 is a round shaft, and supported by the receiving parts 47*a* (see FIG. 3, FIG. 4A and FIG. 4B) formed on the bottom plate 31*a* of the body part 31. The receiving parts 47*a* are externally fitted to the shaft 61.

Both end portions of the shaft 61 penetrate bearing parts 63 provided on the front and rear side plates 31*b* and 31*c* of the body part 31, as shown in FIG. 5. The rear end portion 61*r* of the shaft 61 penetrates the rear side wall 31*c* and is connected to a drive motor through a coupling and a gear trains (not shown). The front end portion of the shaft 61 is rotatably supported by the front side plate 31*b*. The lift plate 35 is turned on the downstream side with respect to the shaft 61, and is disposed between the downstream end portion of the central part 51 of the placement plate 33 and the bottom plate 31*a*.

As shown in FIG. 2, the side cursors 37 include a front cursor 37F and a rear cursor 37R. As shown in FIG. 4, the front cursor 37F has a vertical abutment wall 71F along the feeding direction X and a rack plate 73F extending rearward along the width direction Y from the lower end of the abutment wall 71F. A rack gear 75F is formed on the upstream side edge of the rack plate 73F. The rear cursor 37R has a vertical abutment wall 71R along the feeding direction X and a rack plate 73R extending forward along the width direction Y from the lower end of the abutment wall 71R. A rack gear 75R is formed on the downstream side edge of the rack plate 73R. The front rack plate 73F is made of resin, and the rear abutment wall 71R and the rear rack plate 73R are made of metal (for example, sheet metal). As described above, the sheet feeding cassette 21 is attached to and detached from the apparatus main body 2 along the front-and-rear direction. When the sheet feeding cassette 21 is attached to the apparatus main body 2, a load is applied to the rear abutment wall 71R and the rack plate 73R by the stored sheets, so the rear abutment wall 71R and the rack plate 73R are made of metal to increase the strength. On the other hand, the front rack plate 73F is made of resin because no load is applied from the stored sheets and high strength is not required. The front abutment wall 71F may also be made of resin.

As shown in FIG. 2, the abutment walls 71F, 71R have approximately rectangular notches 77F, 77R cut from the lower edge. Furthermore, as shown in FIG. 5 and FIG. 6, the abutment walls 71F, 71R have recesses 79 (only the front recess 79F is shown in FIG. 5 and FIG. 6) cut from the lower edges on the downstream side of the notches 77F, 77R. Furthermore, the abutment walls 71F, 71R have L-shaped engagement portions (not shown), when viewed from the width direction Y, in the upstream and downstream lower ends.

As shown in FIG. 2, the front and rear cursors 37F, 37R are placed on the bottom plate 31*a* of the body part 31 such that the respective abutment walls 71F, 71R face each other in the width direction Y. At this time, the third overhang 53-3 of the placement plate 33 enters into the notches 77F, 77R of the abutment walls 71F, 71R. Also, as shown in FIG. 6 and FIG. 7, the recesses 79 of the abutment walls 71F, 71R are externally fitted to the shaft 61 of the lift plate 35. Furthermore, the engagement portions of the abutment walls 71F, 71R are engaged with the first and second guide grooves 49*a*, 49*b* of the bottom plate 31*a*. The rack plates 73F, 73R are engaged with the first rails 43 formed on the bottom plate 31*a*, and the rack gears 75F, 75R of the rack plates 73F, 73R are engaged with a pinion gear 81 (see FIG. 5 and FIG. 6) supported on the bottom plate 31*a*.

When the abutment wall 71F of the front cursor 37F is moved in one direction along the first and second guide grooves 49*a*, 49*b*, the rack plate 73F moves along the first rail 43 together with the abutment wall 71F, and the pinion gear 81 is rotated. Then, the rack plate 73R of the rear cursor 37R moves along the first rail 43 in the other direction, and the abutment wall 71R moves along the first and second guide grooves 49*a*, 49*b* in the other direction. Since the rack plates 73F, 73R are provided with bearings (not shown), the rack plates 73F, 73R are moved smoothly. As a result, the abutment walls 71F, 71R move synchronously in a direction approaching or separating from each other. In this way, the rack plates 73F, 73R and the pinion gear 81 are an example of an interlocking mechanism which moves the pair of side cursors 37F, 37R interlocking in the width direction Y.

At this time, as shown in FIG. 2, both the abutment walls 71F, 71R pass between the second and third overhangs 53-2, 53-3 and between the third and fourth overhangs 53-3, 53-4 of the placement plate 33. Both the abutment walls 71F, 71R are moved in the direction approaching each other, and the facing vertical surfaces of the abutment walls 71F, 71R abut against the side edges of the sheets placed on the placement plate 33, such that the sheets are positioned relative to the center in the width direction Y. Thus, the inner surfaces of the abutment walls 71F, 71R regulate the position of the sheets.

Furthermore, the sheet feeding cassette 21 includes an end cursor 95 on the bottom plate 31*a* of the body part 31, as shown in FIG. 2. The end cursor 95 is engaged with the second rail 45 of the bottom plate 31*a*, and moves along the second rail 45 in the feeding direction X. The end cursor 95 abuts against the edge of the sheets placed on the placement plate 33 to position the sheet in the feeding direction X.

The sheet feeding operation of the sheets stored in the sheet feeding cassette 21 having the above configuration will be described. First, the sheet feeding cassette 21 is pulled out of the apparatus main body 2, the sheet bundle is placed on the placement plate 33, and the downstream edge of the sheet bundle is brought into contact with the right side plate 31*e* of the body part 31. Then, one of the side cursors 37F, 37R is moved to abut on the side edge of the sheet bundle. This causes the other side cursor to move synchronously, and the regulating surfaces of the abutment walls 71F, 71R abut against the side surfaces of the sheet bundle to position the sheet bundle in the width direction Y. When the side cursors 37F, 37R are moved in this way, the rack plates 73F, 73R are moved in the width direction Y along the first rails 43, and the abutment walls 71F, 71R are moved in the width direction Y along the first and second guide grooves 49*a* and 49*b* and the shaft 61 of the lift plate 35. In detail, the recesses 79 of the abutment walls 71F, 71R are slid on the shaft 61.

Then, the end cursor 95 is moved along the second rail 45 to abut on the upstream edge of the sheet bundle. This positions the sheet bundle in the feeding direction X.

Then, the sheet feeding cassette 21 is attached to the apparatus main body 2. Then, the coupling connected to the rear end portion 61*r* of the shaft 61 of the lift plate 35 is connected to the motor of the apparatus main body 2. When the motor is subsequently driven, the shaft 61 is rotated to turn the lift plate 35 to the upstream side. Then, the downstream end portion of the placement plate 33 is lifted by the lift plate 35, and the placement plate 33 is turned from the horizontal posture to the inclined posture. As a result, the downstream end portion of the sheet bundle placed on the placement plate 33 is lifted. When the downstream end portion of the upper surface of the sheet bundle reaches the predetermined feeding height, the motor stops the driving. When the placement plate 33 is turned, the third overhang part 53-3 of the placement plate 33 passes through the notches 77F, 77R of the abutment walls 71F, 71R of the side cursors 37F, 37R. In addition, the fourth overhang part 53-4 passes downstream of the side cursors 37F, 37R.

As is clear from the above description, according to the sheet feeding cassette 21 of the present invention, since both the end portions of the shaft 61 of the lift plate 35 are supported by the front and rear side plates 31*b*, 31*c* of the body part 31, the load applied from the placement plate 33 to the lift plate 35 is applied to the front and rear side plates 31*b*, 31*c*. Furthermore, since the shaft 61 is supported by the receiving parts 47*a* protruding from the bottom plate 31*a* of the body part 31, the load is also applied to these receiving parts 47*a*, that is, the bottom plate 31*a*. Since the receiving parts 47*a* are arranged at the center portion and at both the end portions in the width direction Y, the load is distributed and applied in the width direction Y, and the biased deformation of the body part 31 (the bottom plate) can be prevented.

For example, if the lift plate is fixed to one end of the shaft and the shaft is supported by the center portion and one end portion of the bottom plate of the sheet feeding cassette as in the prior art described above, the load applied to the lift plate may cause the bottom plate to deform into a concave shape protruding downward as viewed from the feeding direction X. However, when the shaft 61 is supported at the center portion and at both the end portions in the width direction Y as in the present embodiment, the load applied to the lift plate 35 is distributed in the width direction Y, so that the deformation of the bottom plate 31*a* can be prevented. The shaft 61 may be supported only by the receiving parts 47*a* arranged at the center portion and at both the end portions of the bottom plate 31*a*, or by the receiving parts 47*a* arranged at the center portion of the bottom plate 31*a* and the bearing parts 63 provided in the front and rear side plates 31*b*, 31*c*.

Furthermore, the receiving part 47*a* has a U-shaped concave arc shape when viewed from the width direction Y, and is externally fitted to the shaft 61 so that the rotation of the shaft 61 can be smoothly guided.

In addition, both the end portions of the shaft 61 are supported by the front and rear side plates 31*b*, 31*c* of the body part 31, outside in the width direction Y of the side cursors 37F, 37R which are moved to the most separate position. Thus, when the side cursors 37F, 37R are moved, the rack plates 73F, 73R are guided along the first rails 43 formed on the bottom plate 31*a*, and the abutment walls 71F, 71R are guided along the shaft 61. Therefore, the abutment walls 71F, 71R and the rack plates 73F, 73R can be stably moved in the width direction Y while maintaining a positional relationship between them, and the work of moving the side cursors 37F, 37R can be smoothly performed.

Although the invention has been described for a specific embodiment, the invention is not limited to the above embodiment. Those skilled in the art are able to modify the above embodiment as long as it does not deviate from the scope and spirit of the invention.

The invention claimed is:

1. A sheet feeding cassette comprising:

a body part in which a sheet to be fed along a predetermined feeding direction is stored;

a placement plate disposed on a bottom plate of the body part and having a sheet placement surface on which the sheet is placed;

a shaft extending along a width direction intersecting the feeding direction;

a lift plate disposed between the bottom plate and the placement plate and configured to be turned around the shaft to lift and lower a downstream end portion of the placement plate in the feeding direction;

a pair of side cursors movably supported on the bottom plate in directions approaching and separating from each other along the width direction to position the sheet placed on the sheet placement surface in the width direction; and guide grooves formed in the bottom plate along the width direction to guide movement of the side cursors, wherein both end portions of the shaft are rotatably supported by bearing parts provided in the body part, outside in the width direction of the side cursors disposed at the most separate position in the width direction, the side cursors each has:

an abutment wall abutting on a side surface of the sheet; and a recess formed at a lower end portion of the abutment wall and externally fitted to the shaft from above, and the recess slides on the shaft when the side cursors move in the width direction.

2. The sheet feeding cassette according to claim 1, wherein the bottom plate has a plurality of receiving parts formed in upper edges of ribs provided along the feeding direction and supporting the shaft from below, and the receiving parts are arranged at a center portion and both end portions in the width direction.

3. The sheet feeding cassette according to claim 2, wherein the shaft is a round shaft with a predetermined diameter, and the receiving parts have a concave shape in an arc shape when viewed from in width direction, and are externally fitted to the shaft.

4. The sheet feeding cassette according to claim 1, wherein the body part has side plates provided along both ends of the bottom plate in the width direction and facing each other in the width direction, and the bearing parts are provided on the side plates.

5. The sheet feeding cassette according to claim 1, wherein the guide grooves includes first and second guide grooves arranged on an upstream and downstream sides of the shaft in the feeding direction.

6. The sheet feeding cassette according to claim 1, wherein an upstream end portion of the lift plate in the feeding direction is pivotably connected to the shaft, and pivoted around the shaft such that a downstream end portion of the lift plate in the feeding direction abuts on the placement plate and lifts a downstream end portion of the placement plate.

7. The sheet feeding cassette according to claim 1, further comprising:

an interlocking mechanism which moves the side cursors in conjunction with each other in the width direction, wherein the interlocking mechanism includes:

a pinion gear rotatably supported on the bottom plate; and a rack plate extending from a lower end of each of the abutment walls of the side cursors toward a center in the width direction and having a rack gear engageable with the pinion gear, and the shaft is positioned on a downstream side of the rack plate in the feeding direction.

8. An image forming apparatus comprising:

the sheet feeding cassette according to claim 1; and an image forming part which forms an image on the sheet fed from the sheet feeding cassette.

* * * * *